US009512676B2

(12) United States Patent
Holst et al.

(10) Patent No.: US 9,512,676 B2
(45) Date of Patent: Dec. 6, 2016

(54) MAST LEG PULLEY

(71) Applicant: PATTERSON-UTI DRILLING COMPANY LLC, Snyder, TX (US)

(72) Inventors: Katherine J. Holst, Houston, TX (US); Michael F. Jones, Conroe, TX (US); Tyson Andrew Springer, Edmonton (CA); Kristopher Landon Murray Butler, Edmonton (CA); Bradley James Schroeder, Edmonton (CA); Christopher Medland, Edmonton (CA)

(73) Assignee: PATTERSON-UTI DRILLING COMPANY LLC, Houston, TX (US)

( * ) Notice: Subject to any disclaimer, the term of this patent is extended or adjusted under 35 U.S.C. 154(b) by 0 days.

(21) Appl. No.: 14/639,856

(22) Filed: Mar. 5, 2015

(65) Prior Publication Data

US 2016/0258215 A1 Sep. 8, 2016

(51) Int. Cl.
*E21B 7/02* (2006.01)
*E21B 15/00* (2006.01)

(52) U.S. Cl.
CPC ..... *E21B 7/023* (2013.01); *E21B 15/00* (2013.01)

(58) Field of Classification Search
CPC ..... E21B 7/023; E21B 15/00
USPC ..... 52/116, 120; 212/347, 299, 300
See application file for complete search history.

(56) References Cited

U.S. PATENT DOCUMENTS 2,204,713 A * 6/1940 White, Jr. ..... E04H 12/187 414/592
3,228,151 A * 1/1966 Woolslayer ..... E21B 15/00 173/39
3,483,933 A * 12/1969 Dyer ..... E21B 15/00 173/39
3,693,729 A * 9/1972 Blurton ..... B60V 3/025 114/264
3,783,627 A * 1/1974 Blurton ..... B60V 3/025 114/43
3,807,109 A * 4/1974 Jenkins ..... E21B 15/00 173/151
3,908,784 A * 9/1975 Blurton ..... B60V 3/025 180/116
4,221,088 A * 9/1980 Patterson ..... E21B 15/00 52/116
4,249,600 A 2/1981 Bailey
4,375,241 A * 3/1983 Gallon ..... E21B 15/00 173/151

(Continued)

FOREIGN PATENT DOCUMENTS

WO 2013158695 A2 10/2013

OTHER PUBLICATIONS

PCT International Search Report for PCT International Patent Application No. PCT/US2016/018294, mailed Jul. 20, 2016.

*Primary Examiner* — Brent W Herring
(74) *Attorney, Agent, or Firm* — Holland & Hart LLP

(57) ABSTRACT

A mast system includes a first leg of a mast pivotally connected to a pivot support and a second leg of the mast pivotally connected to a leg support. The leg support has a first support end with a surface connector to attach to a rig surface and a second support end with a leg connector to connect to the second leg to form a joint. A cable with a first cable end is attached to the leg support, and a force is exerted on the leg support through the cable that causes the leg support to rotate about the joint when the mast is lowered.

18 Claims, 9 Drawing Sheets

(56) References Cited

U.S. PATENT DOCUMENTS

| | | | | |
|---|---|---|---|---|
| 4,471,587 | A * | 9/1984 | Ahmad | E21B 15/00 52/120 |
| 4,587,778 | A * | 5/1986 | Woolslayer | E21B 15/00 52/116 |
| 4,759,414 | A | 7/1988 | Willis | |
| 4,821,816 | A | 4/1989 | Willis | |
| 4,831,795 | A * | 5/1989 | Sorokan | E21B 15/00 414/917 |
| 7,308,953 | B2 * | 12/2007 | Barnes | E21B 7/02 175/122 |
| 8,046,959 | B2 | 11/2011 | Stoetzer et al. | |
| 8,353,132 | B1 | 1/2013 | Vogt et al. | |
| 8,549,815 | B2 | 10/2013 | Donnally et al. | |
| 8,556,003 | B2 * | 10/2013 | Souchek | E21B 7/02 175/162 |
| 8,646,240 | B1 | 2/2014 | Patrick et al. | |
| 8,720,128 | B2 | 5/2014 | Vogt | |
| 9,016,004 | B2 * | 4/2015 | Vogt | E21B 7/023 52/118 |
| 2007/0175134 | A1 | 8/2007 | Christenson | |
| 2011/0072737 | A1 | 3/2011 | Wasterval | |
| 2012/0167485 | A1 | 7/2012 | Trevithick et al. | |
| 2015/0047290 | A1 | 2/2015 | Konduc et al. | |

* cited by examiner

MAST LEG PULLEY

BACKGROUND

The expense of transporting and setting up drilling rigs at different drill sites can be time consuming and costly. Transporting the equipment for drilling oil and gas wells is often costly because such equipment is heavy and bulky. For example, modular drill rigs often include a mast of over a hundred feet when fully erected, a drilling floor, and a substructure to support the drilling floor and mast. The substructure raises the drilling floor off of the ground at a sufficient height to accommodate drill equipment connected to the well bore, such as a blowout preventer.

Transporting the rig generally includes disassembling the components of the drill rig into manageable loads that meet government regulations for transport on truck beds and trailers. At the new drill site, the rigs are assembled in place before the well head equipment is positioned in place.

One type of modular rig is disclosed in U.S. Pat. No. 8,720,128 issued to Dewayne G. Vogt. In this reference, a method to disassemble a mast assembly having a substructure including a first and second section, a first and a second cylinder, and a lower mast section. The method includes the steps of disengaging a pair of front mast legs of the lower mast section from a pair of front leg supports. The pair of front leg supports are moved from an operational to a transport position. The lower mast section is lowered from a vertical to a horizontal position by retracting the first cylinder and the second cylinder. A mast center spreader is thereafter removed from the lower mast section. A center drill floor section is removed from between the first substructure section and the second substructure section so that a combination of the first substructure section, the first cylinder and a portion of the lower mast and a combination of the second substructure section, the second cylinder and a portion of the lower mast may be transported. Another type of system is described in U.S. Patent Application No. 2012/0167485 issued to Mark W. Trevithick, et al. All of these documents are herein incorporated by reference for all that they contain.

SUMMARY

In one aspect of the principles described herein, a mast system includes a first leg of a mast pivotally connected to a pivot support and a second leg of the mast pivotally connected to a leg support. The leg support has a first support end with a surface connector to attach to a rig surface and a second support end with a leg connector to connect to the second leg to form a joint. A cable with a first cable end is attached to the leg support, and a force is exerted on the leg support through the cable that causes the leg support to rotate about the joint when the mast assembly is lowered.

In some examples, the cable has a second cable end that is attached to a fixed location. In some cases, the fixed location is the pivot support. Further, the rig surface may be part of a mast transport skid, the drill rig, or other component. Such a mast transport skid may be transported with a portion of the mast from drill site to drill site. Also, the force exerted on the leg support may cause the leg support to move into a transport position.

The first leg may be a back leg of the mast assembly, and the second leg may be a front leg of the mast assembly. The mast assembly may also include a first pulley connected to the back leg. The first pulley may be positioned to angle the first portion of the cable. A distance between a fixed end of the cable and the first pulley may increase as the mast section is lowered. The increased distance may passively exert a force that moves the leg support. The distance between the fixed end of the cable and the first pulley may decrease as the mast section is raised. The decreased distance may passively release the force allowing the leg support to rotate downward. Passively releasing the force allows the leg support to move into an operational position where the first support end aligns with a support connector incorporated into the rig surface.

A second pulley may be connected to the mast section. The first pulley may be positioned at a higher elevation than the second pulley when the mast section is in an upright position. A third pulley may be connected to the mast section that is positioned to direct the first cable end in an upward direction when the mast section is being lowered.

In another aspect of the principles described herein, a drill rig includes a back leg of a lower mast section pivotally connected to a pivot support a front leg of a lower mast section pivotally connected to a leg support. The leg support has a first support end with a surface connector to attach to a rig surface and a second support end with a leg connector to connect to the second leg to form a joint. A cable with a first cable end is attached to the leg support, and a first pulley connected to the back leg. The first pulley is positioned to angle a first portion of the cable. A distance between a fixed end of the cable and the first pulley increases as the mast section is lowered. A force is exerted on the leg support through the cable that causes the leg support to rotate about the joint as the mast section is lowered.

In some examples, the distance between a fixed end of the cable and the first pulley decreases as the mast section is raised wherein the decreased distance passively releases the force allowing the leg support to rotate downward. Passively releasing the force may allow the leg support to move into an operational position where the first support end aligns with a support connector incorporated into the rig surface. A second pulley may be connected to the mast section where the first pulley is positioned at a higher elevation than the second pulley when the mast section is in an upright position. A third pulley may be connected to the mast section and is positioned to direct the first cable end in an upward direction when the mast section is being lowered.

In yet another aspect of the principles described herein, a drill rig includes a back leg of a mast section pivotally connected to a pivot support. A front leg of a mast section is pivotally connected to a leg support. The leg support has a first support end with a skid connector to attach to a mast transport skid and a second support end with a leg connector to connect to the second leg to form a joint. A cable with a first cable end is attached to the leg support. A first pulley is connected to the back leg, and the first pulley is positioned to angle a first portion of the cable. A second pulley is connected to the mast section, the first pulley being positioned at a higher elevation than the second pulley when the mast section is in an upright position. A third pulley is connected to the mast section and is positioned to direct the first cable end in an upward direction when the mast section is being lowered. A distance between a fixed end of the cable and the first pulley increases as the mast section is lowered. A force is exerted on the leg support through the cable that causes the leg support to rotate about the joint into a transport position as the mast section is lowered. The distance between a fixed end of the cable and the first pulley decreases as the mast section is raised wherein the decreased distance passively releases the force allowing the leg support to rotate downward. Passively releasing the force allows the leg support to move into an operational position where the first support end aligns with a support connector incorporated into the mast transport skid.

Any of the aspects of the principles detailed above may be combined with any of the other aspect detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

The process of disassembling the components of the drill rig, transporting the drill rig, and reassembling the components of the drill rig are time consuming and costly. Reducing the number of task for disassembling and assembling the drill rig can speed up the process of moving the drill rig and thereby make the drill rig more productive and profitable. The principles described in the present disclosure include methods for assembling and disassembling drill rigs that shorten the process of setting up and taking down drill rigs. For example, the principles described herein include a mast transport skid that is incorporated into the drill rig. Such a mast transport skid remains in the drill rig after the drill rig is set up and during the operation of the drill rig. The mast transport skid is constructed to span between substructure columns. In some cases, the mast transport skid is supported by a beam that spans the distance between the substructure columns. The mast transport skid can be easily attached and/or disconnected to the substructure columns at the drill site.

The mast transport skid is pivotally connected to the lower mast section and to the cylinder that is used to raise and lower the lower mast section. During disassembly, the lower mast section and the cylinder remain connected to the mast transport skid. Thus, the mast transport skid, the cylinder, and the lower mast section form a transportable unit that is capable of being transported on truck trailers. The mast transport skid can be easily transferred from the trailer to the top of the substructure column. When the mast transport skid is in place, the cylinder can be extended raising the lower mast section into an upright position. If other portions of the mast, such as an upper or middle portion of the mast, are connected to the lower mast section when the lower mast section is raised, the additional portions of the mast are also raised with the lower mast section. The mast transport skid and the methods described herein eliminate several tasks involved with disassembling and assembling drill rigs. For example, having to install the cylinder and having to connect the mast legs to a pivot portion of the drill rig are eliminated. Thus, the set up and take down of the drill rig is reduced making the drill rig more efficient and profitable.

For purposes of this disclosure, the term "aligned" means parallel, substantially parallel, or forming an angle of less than 35.0 degrees. Also, for purposes of this disclosure, the term "transverse" means perpendicular, substantially perpendicular, or forming an angle between 55.0 and 125.0 degrees. Further, for purposes of this disclosure, the term "length" refers to the longest dimension of an object.

Figure 1:
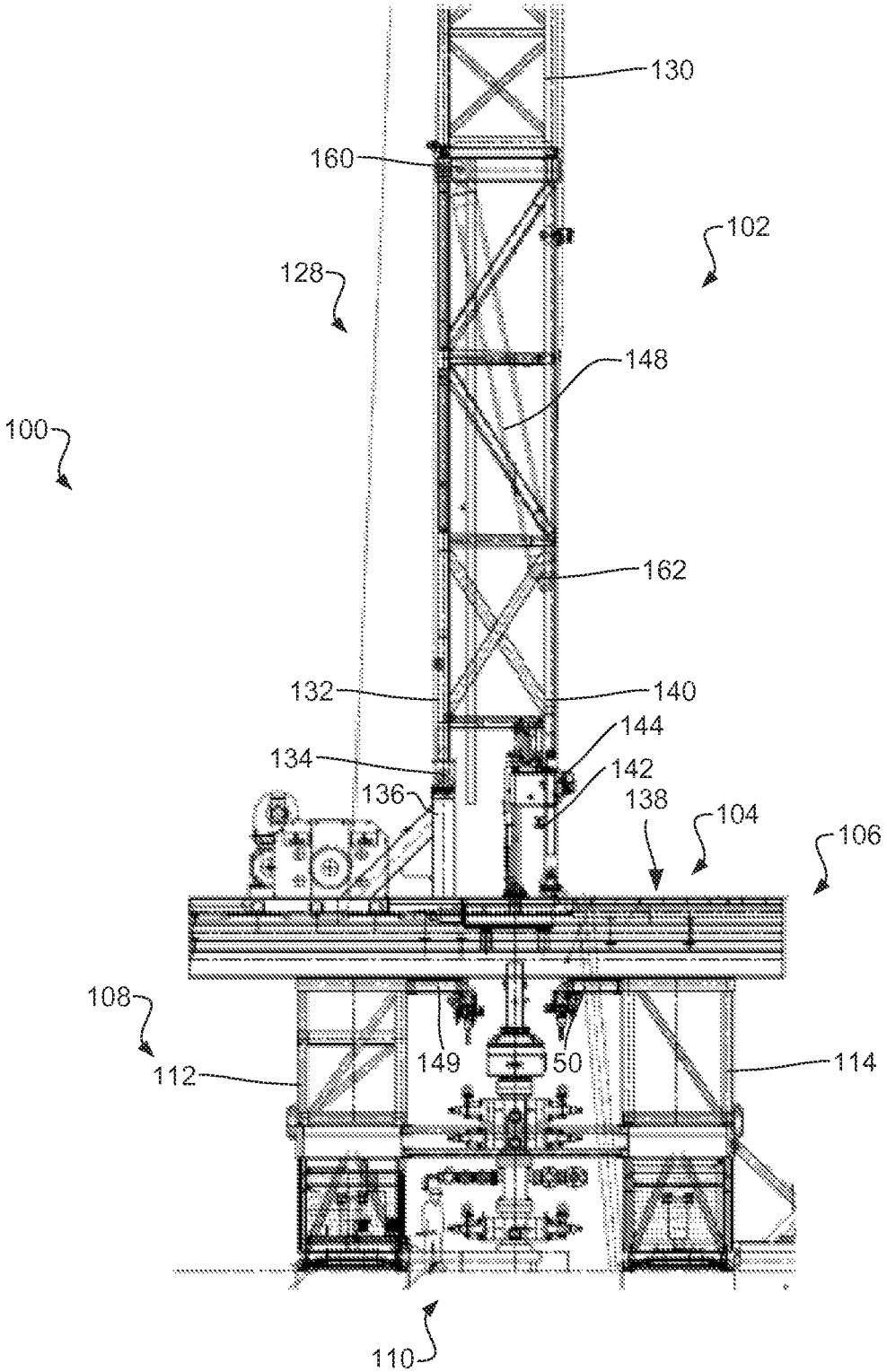
FIG. 1 illustrates a drillers' side view of an example of a drill rig with a mast erected in an upright position in accordance with the present disclosure.
Figure 2:
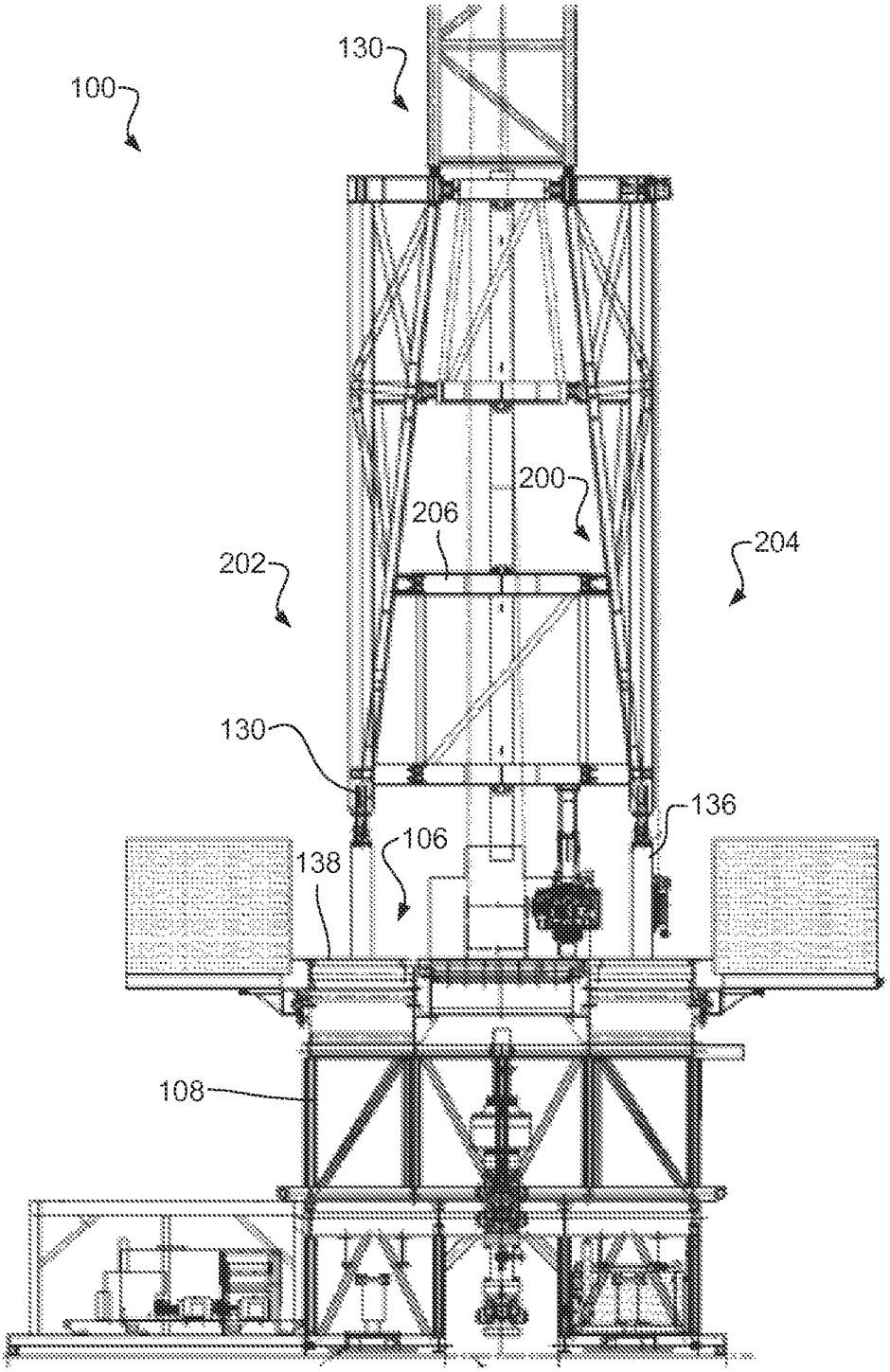
FIG. 2 illustrates a V-door side view of an example of a drill rig with a mast erected in an upright position in accordance with the present disclosure.

Particularly, with reference to the figures, FIGS. 1-2 depict a drill rig 100 in accordance with the present disclosure. In these examples, the drill rig 100 includes a mast 102, a drill floor 104, a mast transport skid 106, and a substructure 108. The substructure 108 supports the mast 102, the drill floor 104, and the mast transport skid 106. The substructure 108 raises the drill floor 104 and mast transport skid 106 to an elevation high enough to accommodate a blowout preventer 110 that is positioned over the wellbore.

In the illustrated examples, the substructure 108 includes at least a first box substructure 112 and a second box substructure 114. The box substructures 112, 114 each include a box frame that includes multiple trusses. The substructure 108 supports the weight of the mast 102, the drill floor 104, the mast transport skid 106, the drill string, personnel operating the drill rig 100, and other equipment. Thus, the substructure 108 can be capable of supporting millions of pounds. In some cases, multiple box substructures are placed on top of each other forming a box on box substructure. However, the principles described herein may be used for any appropriate type of substructure including, but not limited to, skid and trailer type substructures, slingshot type substructures, spin-up type substructures, telescope type substructures, modular type structures, other appropriate type substructures, or combinations thereof.

The mast 102 of the drill rig may include multiple sections. In the illustrated examples, the mast 102 includes a lower mast section 116. The lower mast section 116 includes a V-door 200 incorporated on a front side of the drill rig 100. The V-door 200 is an opening in the lower mast section 116 and is located on the drill floor 104 opposite to the draw works, sets on the back side of the drill rig floor. The V-door is used as an entry point to bring in drill pipe, casing, and other tools involved with drilling operations. The lower mast section includes a driller's side subsection 202 and an off driller's side subsection 204, which can be separated from each other during disassembly by removing the spreader beams 206 located on the back side 128 of the lower mast section 116. Additional mast sections, such as top mast sections or middle mast sections 130, can be added to the mast 102. Such additional mast sections can be added to the lower mast section 116 before the lower mast section 116 or after the lower mast section 116 is in an upright position.

The back legs 132 of both of the side subsections 202, 204 of the lower mast assembly 116 may be connected to pivot connectors 134. Such pivot connectors 134 may be raised off of the drill floor 104 by pivot supports 136. In some examples, the pivot supports 136 are rigidly affixed to the mast transport skid 106. As the mast 102 is raised and lowered, the lower mast section 116 may pivot about the pivot connectors 134. The pivot supports 136 may elevate the pivot connectors 134 to a height that is 5.0 to 15.0 feet above the drill floor 104 and/or a mast transport skid's surface 138.

The front mast legs 140 of the lower mast section 116 are attached to front mast leg supports 142. The front mast legs 140 may form a joint 144 with a leg connector of the front mast leg supports 142. Surface connectors of the front mast leg supports 142 may be attached to front support connectors integrated into a surface of the drill rig 100, mast transport skid, or other surface. In some examples, the surface connector is a skid connector when the connector attaches the front mast leg support 142 to the mast transport skid 106.

The surface connectors, leg connectors, and support connectors may be any appropriate type of connector. For example, the connectors may include pins, bolts, fasteners, hooks, clamps, interlocking features, receptacles, nuts, or other components of connectors. For example, the surface connector of the front mast leg support 142 may include an opening that aligns with at least one opening formed in brackets of the support connector integrated into the rig surface. Such openings of the surface connector and the support connector may collectively receive a single pin that hold the support connector and the surface connector together. In other examples, the surface connector and the support connector are screwed, clamped, or otherwise fastened together. Also, the leg connector of the second end of the front mast leg support 142 may be fastened to the support connector of the front mast leg at the joint. In some examples, a pin is used to hold the leg connector and the support connector together. In such an example, the front mast leg support 142 may rotate about the pin of the joint when the front mast leg support is released from the rig surface.

When disconnected from the front support connectors, the front mast leg supports 142 can rotate about the joint 144. For example, when the lower mast section 116 is lowered into a position aligned with the mast transport skid 106, the lower mast assembly 116 may be lowered with the front side down. In such an example, the front mast leg supports 142 remain connected to the front mast legs 140 and therefore travel with the lower mast section 116. The front mast leg supports 142 can be rotated towards the lower mast section 116 about the joint 144 as the lower mast section 116 is being lowered. As the lower mast section 116 is lowered, the back legs 132 of the lower mast section 116 rotate about the pivot connector 134. Thus, in the lowered, aligned position, the back legs 132 of the lower mast section 116 are facing upward and are raised off of the mast transport skids 106 by the pivot supports 136.

In the example of FIG. 1, a cylinder 148 is depicted in the lower mast section 116. A first end 160 of the cylinder 148 is connected to the lower mast section 116, and a second end 162 of the cylinder 148 is also shown in the lower mast section 116. This cylinder 148 may be used to raise and lower the lower mast section 116 by attaching the second end 162 to the mast transport skid 106. With the first end 160 of the cylinder 148 attached to the mast 102 and the second end 162 attached to the mast transport skid 106, the mast 102 can be raised by extending the cylinder 148. Likewise, the mast 102 can be lowered by retracting the cylinder 148.

In some examples, the cylinder 148 is a single stage cylinder. Such single stage cylinders generally have a simpler construction and are more robust than conventional multi-stage cylinders. In conventional modular drill rigs, multi-stage cylinders are used because the cylinders often need a longer stroke to raise the mast. However, in the illustrated example, the pivot connector 134 of the back legs 132 is raised off of the mast transport skid 106 by 5.0 to 15.0 feet, which reduces the moment on mast 102 as the mast 102 is raised. As a result, the clear height (the height from the pivot connector 134 to the top of the mast) is low enough that a single stage cylinder is capable of raising the mast 102. In one example where the mast 102 includes the lower mast section 116, a middle mast section 130, and a top mast section, the clear height of the mast may be about 142.0 feet. However, the mast 102 may include any appropriate clear height. For example, the clear height may be between 100.0 and 160.0 feet, another height, or combinations thereof.

After the mast 102 has been oriented in the upright position, the second end 162 of the cylinder 148 may be disconnected from the mast transport skid 106 and retracted into the mast 102. With the cylinder 148 in the retracted position, the cylinder 148 is positioned to be out of the way of drilling operations. For example, leaving the cylinder 148 extended with the cylinder's rod exposed may put the surface material of the cylinder's rod at risk. Some types of drilling mud may chemically react with the chrome of certain cylinder rods, and retracting the cylinder 148 into the mast 102 may prevent drilling mud from making contact with the cylinder rod.

A drill string is made of multiple drill pipes and other drill string components threaded together at pipe joints. A drill bit is often secured to the front of the drill sting such that when the drill string is rotated against the formation under a load, a bore hole is formed. The bottom components of the drill string are first lowered through an opening in the blowout preventer 110, which initially guides the drill bit to form the bore hole in the correct location. As the drill bit creates the bore hole, the drill string advances into the formation. Additional drill pipe are added to the drill string as the drill string advances into the formation. As the drill string is lengthened by adding more drill pipe, the weight of the drill string increases.

Further, as the drill bit advances through various subterranean formations, the down hole pressures exerted on the drill string change. For example, the drill string may encounter a high pressure pocket of gas or oil trapped within the earth. As such high pressure pockets are punctured by the drill bit, the pressure is released and may exert a force that causes the oil or gas to rapidly move up the bore hole. The blowout preventer 110 is constructed to prevent such oil or gas such from exiting the top of the bore hole. The blowout preventer has multiple types of valves that can be shut to prevent the oil or gas from exiting the bore hole. In some cases, shutting off the valves damages the drill pipe. The force exerted by such high pressure pockets can be significant. To counteract such forces, the blowout preventers 110 often weigh tens of thousands pounds. Thus, moving the blowout preventer 110 as a single unit during the drill rig's setup involves the use of equipment that is easy to control and reliable.

In the examples depicted in the figures, a first trolley structure 149 is attached to the first box substructure 112, and a second trolley structure 150 is attached to the second box substructure 114. The trolley structures 149, 150 may be permanently attached to the box substructures 112, 114 including during transportation. A first hoist may be connected to the first trolley structure 149, and a second hoist may be connected to the second trolley structure 150. The hoists may be used to lift and position the blowout preventer 110 and other types of equipment during the assembly and disassembly of the drill rig 100.

Figure 3:
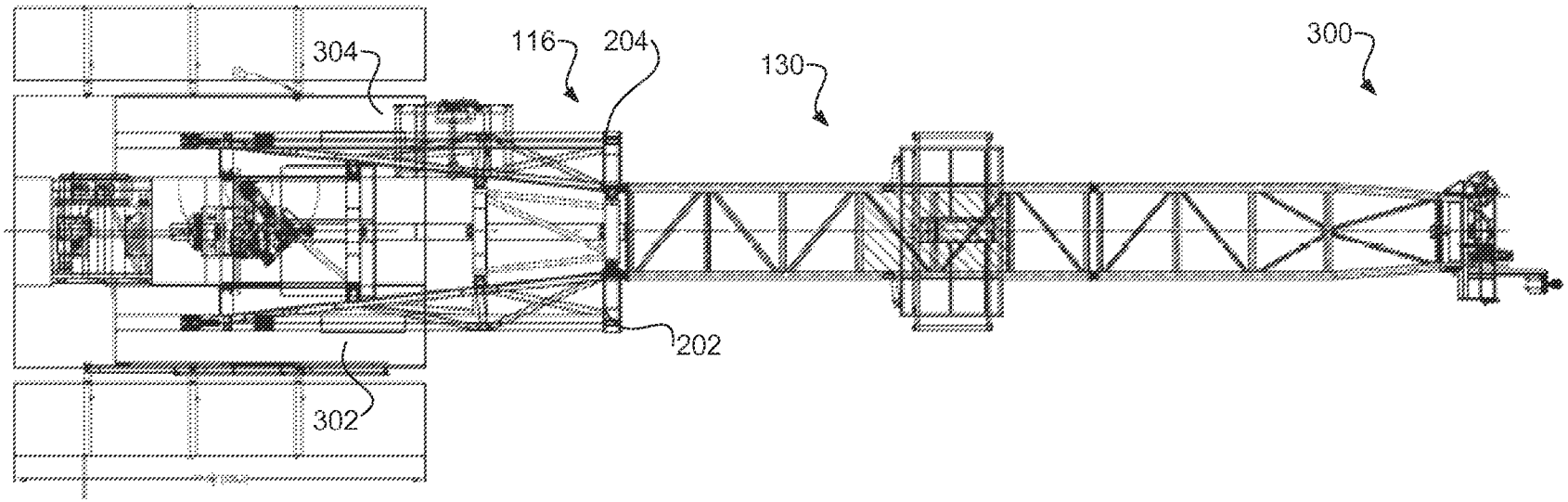
FIG. 3 illustrates a top view of an example of a drill rig with a lowered mast in accordance with the present disclosure.
Figure 4:
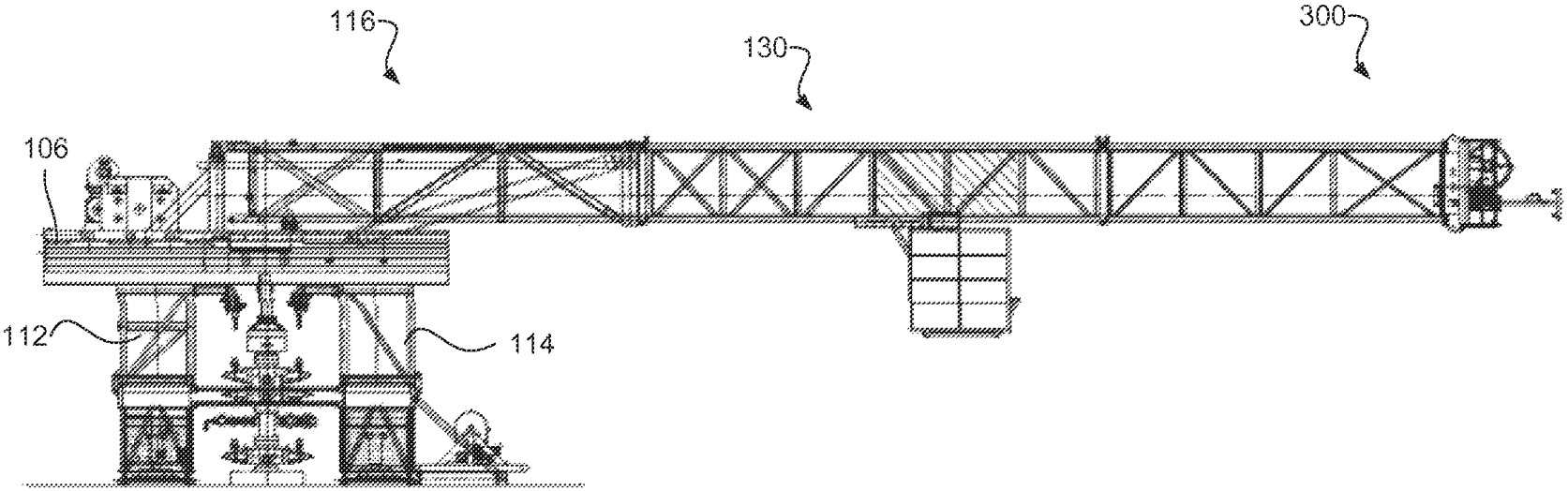
FIG. 4 illustrates a side view of an example of a drill rig with a lowered mast in accordance with the present disclosure.
Figure 5:
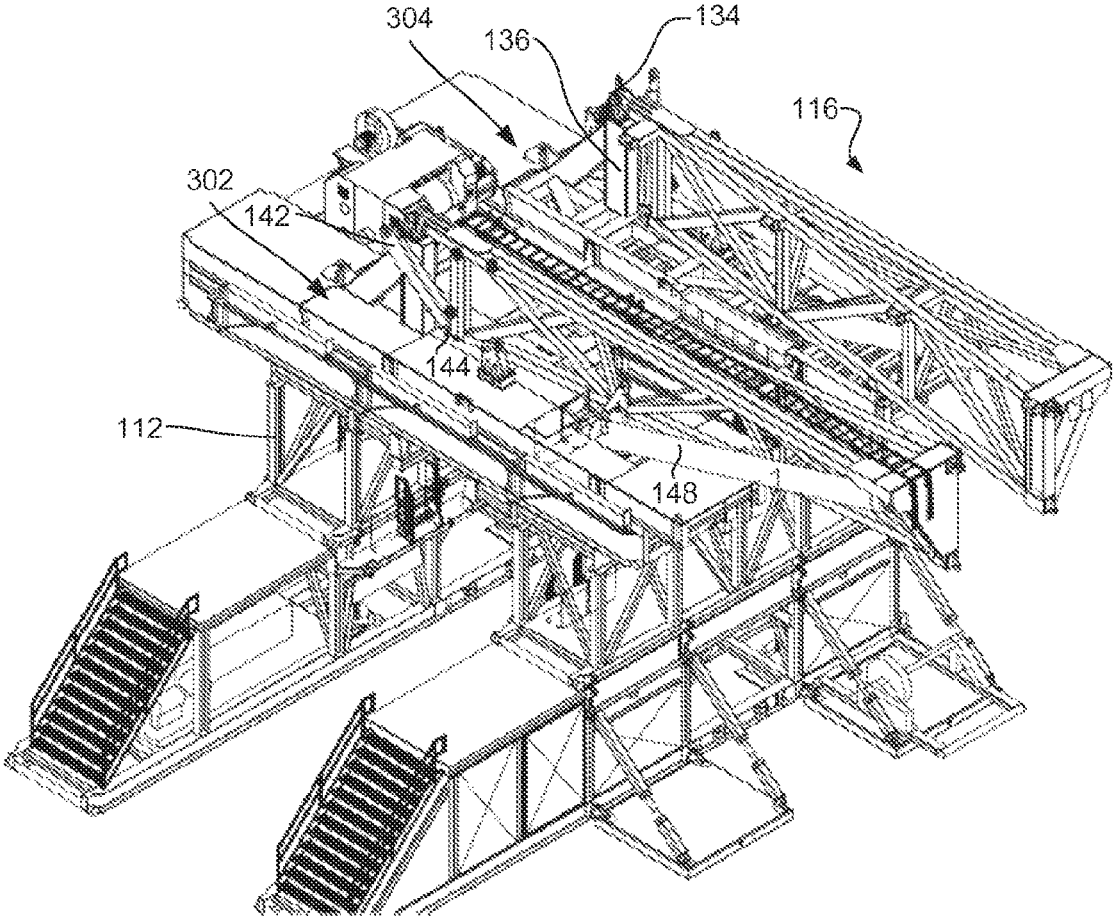
FIG. 5 illustrates a perspective view of an example of a drill rig with a lowered mast in accordance with the present disclosure.

FIGS. 3-5 depict the drill rig 100 with the mast 102 in a lowered position. In the examples of FIGS. 3-4, the mast assembly includes the lower mast section 116, the middle mast section 130, and a top mast section 300. In some examples, the entire mast 102, is lower and raised with all the sections 116, 130, 300 in place. In such examples, the top mast section 300 and the middle mast section 130 may be added or removed while the mast 102 is lowered. FIG. 5 depicts the drill rig 100 with the middle and top mast sections 130, 300 removed.

Also, each of the mast subsections 202, 204 is attached to individual mast transport skids. For example, the driller's side mast subsection 202 is attached to a driller's side mast transport skid 302, and the off driller's side mast subsection 204 is attached to an off driller's side mast transport skid 304. In some examples, a single cylinder is used to raise both of the mast subsections 202, 204 when the mast subsections 202, 204 are connected by the spreader beams 206. In other examples, each of the mast subsections 202, 204 include an individual cylinder. The front mast leg supports 142 are depicted in a rotated position where the front mast leg supports 142 are moved closer to the lower mast section 116 than previously when the front mast leg supports 142 are in their operational position. In the illustrated example, a joint 144 connects the front mast leg 140 and the front mast leg support 142. The joint 144 may be a rotary joint that allows the front mast leg support 142 to freely rotate while staying connected to the front mast leg 140. The support connector 306 is also depicted in the mast transport skid 106. When the front mast leg support 142 is connected to the support connector 306, the front mast leg support 142 is bound at both the first and second ends preventing the front mast leg support 142 from rotating and bares the weight of the mast 102. However, when the front mast leg support 142 is disconnected from the support connector 306, the front mast leg support 142 can pivot out of the way to allow the mast 102 to be lowered.

As described above, the drill rig 100 may be disassembled into transportable units to carry the components of the drill rig 100 to a new drill site. In some examples, the top mast section forms a transportable unit, and the middle mast section forms a different transportable unit. Likewise, the first box substructure 112 may form a transportable unit, and the second box substructure 114 may form another transportable unit. Also, the driller's side mast transport skid 302 along with the driller's side subsection 202 of the lower mast section 116, and their associated cylinder 148 may form a transportable unit. Likewise, the off driller's side mast transport skid 304 along with the off driller's side subsection 204 of the lower mast section 116, and their associated cylinder 148 may form another transportable unit. Each of the transportable units may be transported independently on truck trailers and be within government regulations and industry standards.

For each of the mast transport skid transportable units, the cylinders 148 may remain attached to both the mast transport skid 106 and the lower mast subsection during transport. Keeping the first and second ends of the cylinders 148 attached to the mast transport skids 302, 304 and the appropriate mast subsections 202, 204 provides multiple advantages. One advantage is that the cylinder 148 is already in position to raise the mast 102 once the mast transport skids 302, 304 are secured to the substructures 112, 114.

Figure 6:
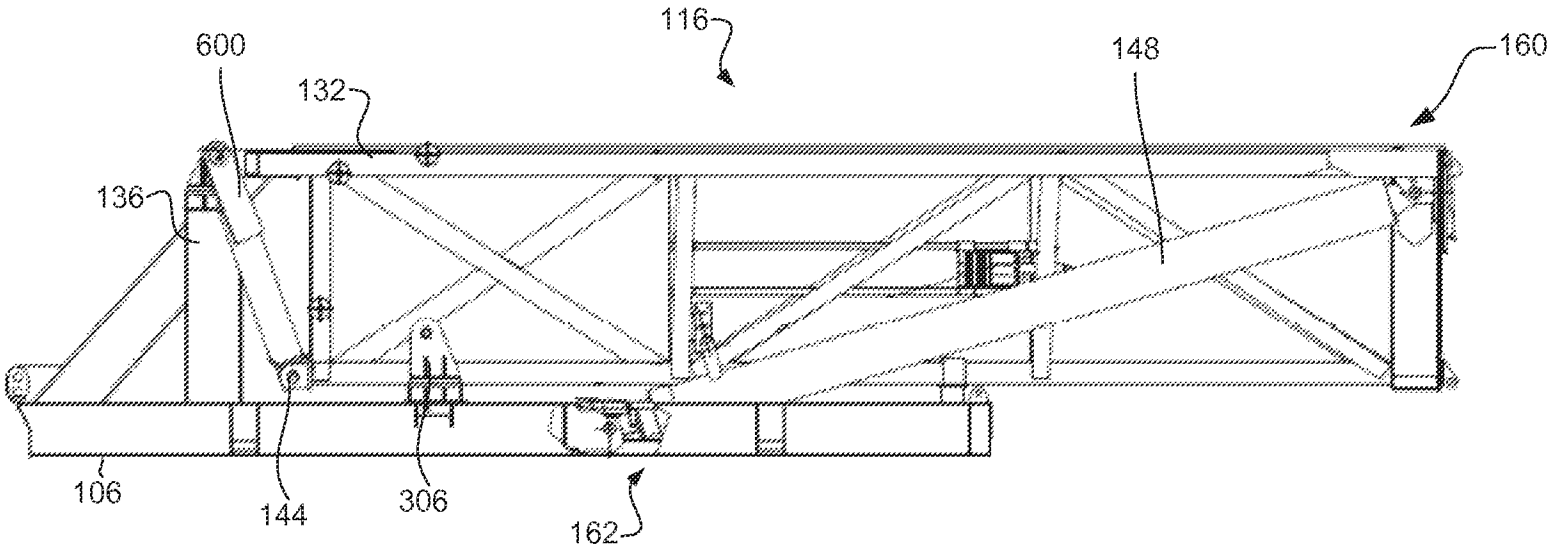
FIG. 6 illustrates a side view of a transportable unit in accordance with the present disclosure.
Figure 7:
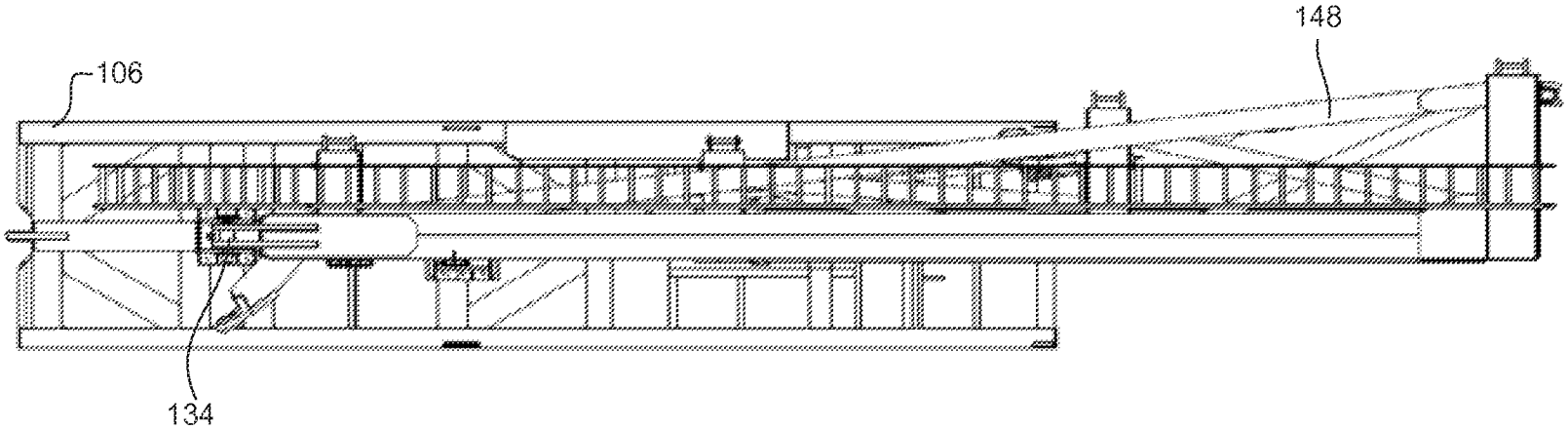
FIG. 7 illustrates a top view of a transportable unit in accordance with the present disclosure.
Figure 8:
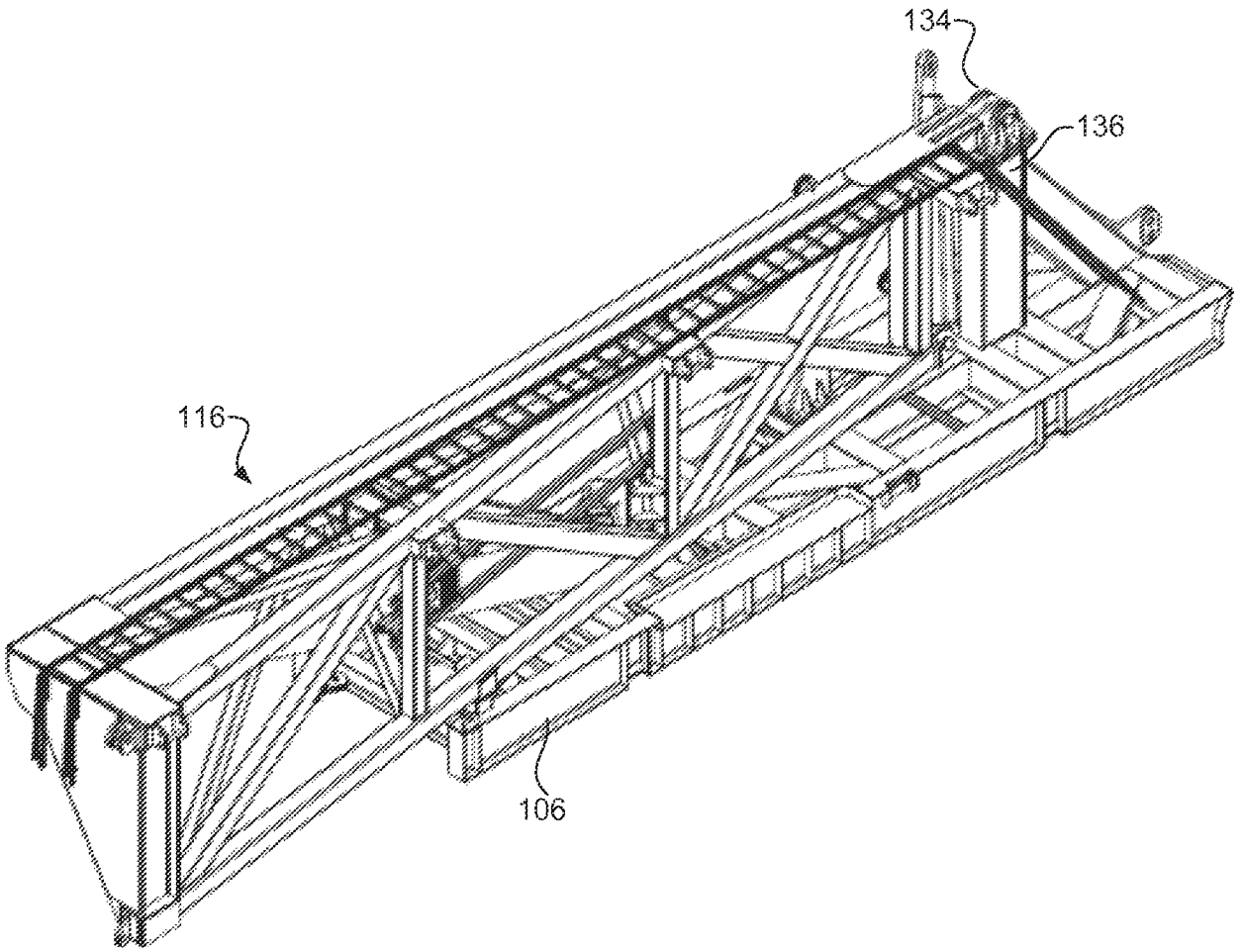
FIG. 8 illustrates a perspective view of a transportable unit in accordance with the present disclosure.

FIGS. 6-8 depict an example of the transportable units that include the mast transport skid 106, the cylinder 148, and the lower mast section 116. As described above, during transportation, the first end of the cylinder 148 is attached to the lower mast section 116, and the second end 162 of the cylinder 148 is attached to the mast transport skid 106. The connection between the second end 162 of the cylinder 148 and the mast transport skid 106 may be a pin connection where the second end 162 of the cylinder 148 may be unpinned after the cylinder 148 has raised the mast 102 during the set-up of the drill rig 100.

During transport, the back legs 132 continue to be connected to the pivot connector 134 that is elevated off of the floor of the mast transport skid 106 with the pivot supports 136. The mast 102 pivots about the pivot connector 134 when the mast 102 is being raised and lowered. Thus, a set-up crew does not have to reconnect the lower mast section 116 to the pivot support 136 during set-up which further reduces the amount of time needed to assemble the drill rig 100.

Also, during transport, the front mast leg support 142 remains connected to the front mast leg 140 at the joint 144. A releasable end 600 of the front mast leg support 142 is rotated towards the pivot support 136 during transport. During assembly of the drill rig 100, the front mast leg support 142 is rotated back into an upright position simultaneously as the mast 102 is raised. This may be accomplished with a pulley/cable system that moves the front mast leg support 142 into place as the cylinder 148 extends. In other examples, the front mast leg support 142 is moved into place manually. However, any appropriate mechanism for moving the front mast leg support 142 into place may be used in accordance with the principles described in the present disclosure. When the front mast leg support 142 is in the proper position, the releasable end 600 of the front mast leg support 142 can be connected to the support connector 306 incorporated into the mast transport skid 106.

Figure 9:
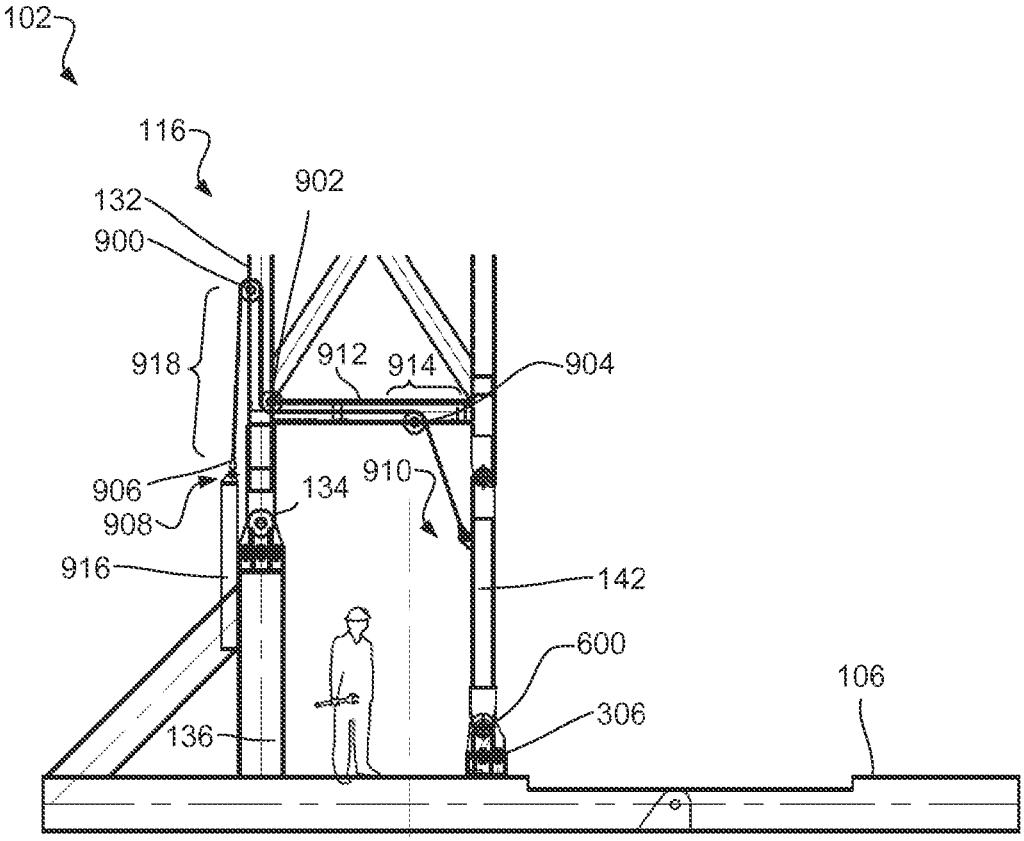
FIG. 9 illustrates a side view of an example of a support leg in an operational position in accordance with the present disclosure.
Figure 10:
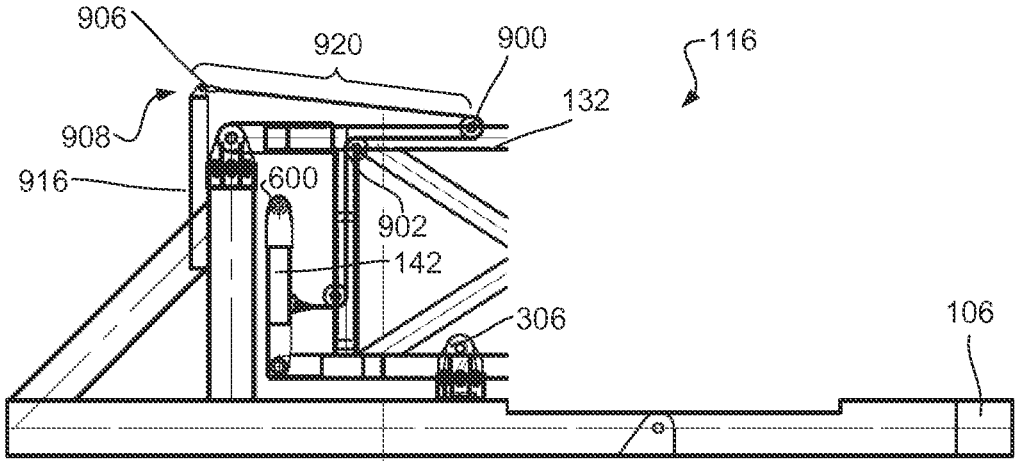
FIG. 10 illustrates a side view of an example of a support leg in a transport position in accordance with the present disclosure.

FIGS. 9-10 illustrate a side view of an example of a support leg. FIG. 9 depicts the support leg in an operational position, and FIG. 10 depicts the support leg in a transport position. In the illustrated examples, the back legs 132 are connected to the pivot support 136 at the pivot connector 134. A first pulley 900 and a second pulley 902 are connected to the back legs 132 of the lower mast assembly 116. A third pulley 904 is also connected to the lower mast assembly 116. A cable 906 is connected to the pivot support 136 at a first cable end 908 and connected to the front mast leg support 142 at a second cable end 910. The first, second, and third pulleys 900, 902, 904 position and angle different portions of the cable 906 to control how the forces generated from lowering the mast 102 are directed through the cable 906.

In the illustrated examples, the third pulley 904 is connected to a mast beam 912 that spans the distance between the back legs 132 and the front mast legs 140. The third pulley 904 is attached to a section 914 of the mast beam 912 that is proximate the front mast legs 140. In some examples, the section 914 of the mast beam 912 is the half of the mast beam 912 closest to the front mast leg 140. In other examples, the section 914 of the mast beam 912 is the third, quarter, quintile, or other fraction of the mast beam 912 that is closest to the front mast leg 140.

While this example has been described with reference to three pulleys, any appropriate number of pulleys may be used in accordance with principles described in the present disclosure. For example, a single pulley may be used. In other examples, four or more pulleys are used. Further, any appropriate type of pulley may be used. In some examples, the pulley includes a wheel supported by and capable of rotating about an axle. Further, any appropriate type of cable may be used. For example, the cable may be include interwoven fibers, such as metal strands, rope fibers, other types of fibers, or combinations thereof. A non-exhaustive list of cables may include metal wires, ropes, belts, chains, chords, other types of materials, other types of cables, or combinations thereof.

In this example, a support extension 916 raises the fixed location of the first cable end 908 to a desired height above the pivot connector 134. However, in other examples, no extension to the pivot support 136 is used. Further, while this example has been described with reference to the fixed location of the first cable end 908 being on the pivot support 136, the fixed location may be located on any appropriate part of the drill rig 100 and/or mast transport skid 106. Also, in alternative examples, the first cable end 908 may be attached to a moving part that still allows the distance between the first cable end 908 and the first pulley 900 to increase when the lower mast section 116 is lowered.

The first pulley 900 is located a first distance 918 from the fixed location of the first cable end 908 when the lower mast section 116 is in the upright position. As the cylinders 148 lower the mast 102, the distance between the fixed location and the first pulley 900 increases to a second distance 920. The second distance 920 is longer than the first distance 918 thereby causing a force that pulls the second cable end 910 towards the mast beam 912. As the second cable end 910 is pulled towards the mast beam 912, the unpinned releasable end 600 of the front mast leg support 142 is pulled towards the mast beam 912 away from the support connector 306. While this example has been described with reference to the front mast leg support 142 being pulled towards the mast beam 912, the front mast leg support 142 may be pulled in any appropriate direction as long as the direction moves the front mast leg support 142 away from the support connector 306.

The front mast leg support 142 remains pinned to the joint 144 as the front mast leg support 142 is moved away from the support connector 306 by the cable 906. In some examples, the front mast leg support 142 rotates about the joint 144 as the mast 102 is lowered. The movement of the front mast leg support 142 causes the releasable end 600 to rotate out of the way of the lowering mast 102. As the front mast leg support 142 moves, the front mast leg support 142 may rotate in a substantially linear direction. In other examples, the movement of the front mast leg support 142 may include linear rotation as well as some transverse rotation.

The direction of the front mast leg support 142 is based, in part, on the type of joint 144 connecting the front mast leg support 142 to the front mast leg 140. Any appropriate type of joint 144 may be used in accordance with the principles described in the present disclosure. A non-exhaustive list of joint types that may be used include knuckle joints, pin joints, cotter joints, screw joints, cylindrical joints, prismatic joints, hinge joints, other types of mechanical joints, other types of joints, or combinations thereof.

In the example of FIG. 10, when the mast 102 is in the mast transport position, the front mast leg support 142 is also in an upright position. The cable 906 supports the front mast leg support 142 in the upright position. Such a position is out of the way for lowering the mast 102. The mast 102 in the mast transport position now occupies at least part of the space that was previously occupied by the front mast leg support 142 when front mast leg support 142 was in its operational position. Thus, the pulley system as described herein allows for the front mast leg support 142 to be removed at the same time that the mast 102 is lowered. This eliminates at least one task involved with setting up conventional rigs, thereby reducing the time to dissemble the drill rig 100 and making the drill rig 100 more profitable.

During assembly of the drill rig 100, the cylinder 148 raises the mast 102. As the mast 102 is raised, the second distance 920 between the first pulley 900 and the fixed location decreases. As this distance decreases, slack in the cable 906 is produced allowing the front mast leg support 142 to succumb to gravity at the rate that the mast 102 is raised. As the front mast leg support 142 moves in response to the slack in the cable 906, the support's releasable end 600 moves farther from the mast beam 912 and closer towards the support connector 306 integrated into the mast transport skid 106. When the mast 102 is in the upright position, the front mast leg support 142 has also returned to its operational position where the releasable end 600 can be fastened to the support connector 306 to secure the mast 102 in its upright position.

While the examples above have been described with reference to a front mast leg support 142 with a single solid body, the front mast leg support 142 may include multiple segments that collapse as the mast is lowered. For example, the front mast leg support 142 may include telescoping sections that collapse in response to lowering the mast 102. In other alternative examples, the front mast leg support 142 may include at least one bendable joint. In such an example, the cable may be caused to exert a first force on the front mast leg support 142 to cause the front mast leg support 142 to rotate about the joint 144, and a second cable may be guided by a second set up pulleys to exert a different load to cause the front mast leg support segments to bend with respect to each other. Any number of cables with their respective sets of pulleys may be used to apply forces to the front mast leg support 142 to cause front mast leg support to orient, rotate, bend, or otherwise move out of the way of the lowering mast. Likewise, such forces may be released when the mast 102 is raised to align the front mast leg support 142 with the support connector 306.

In yet other examples, a second cable is used to apply an active force on the front mast leg support 142 when the mast 102 is being raised. In such an example, the second cable may be guided by a set of pulleys and have a first cable end secured to a fixed location. As the mast 102 is raised from the lowered, horizontal position, a distance between the fixed end of the second cable and a first pulley of the second set of pulleys may increase causing a force to be exerted on the second cable. The second end of the second cable may be connected to the front mast leg support 142 so that when the mast 102 is raised, the second cable exerts a force on the front mast leg support 142 that causes the front mast leg support 142 to align with the support connector 306 in the rig surface.

Also, while the examples described above have been depicted in the figures with reference to specific locations where the cylinder 148 connects to the mast 102 and to the mast transport skid 106, the cylinders 148 may connect to the mast 102 and mast transport skid 106 at any appropriate locations. For example, the cylinder 148 may connect at an end of the mast transport skid 106, in the middle of the mast transport skid 106, on a side of the mast transport skid 106, another location of the mast transport skid 106, to an attachment of the mast transport skid 106, or combinations thereof. Similarly, the cylinder 148 may connect to a top of the lower mast section 116, to a side of the lower mast section 116, to a middle of the lower mast 102, to a top of the mast 102, to a beam of the mast 102, a bottom of the lower mast section 116, another region of the mast 102, or combinations thereof.

What is claimed is:

1. A mast system, comprising:

a first leg of a mast pivotally connected to a pivot support at a pivot connector;

a second leg of the mast pivotally connected to a leg support;

the leg support having a first support end with a surface connector to attach to a rig surface and a second support end with a leg connector to connect to the second leg to form a joint; and a cable with a first cable end attached to the leg support;

the first leg is a back leg of the mast and the second leg is a front leg of the mast;

a first pulley connected to the back leg, the first pulley positioned to angle a first portion of the cable with respect to another portion of the cable;

wherein the first leg rotates about the pivot connector when the mast is raised to an upright position.

2. The mast system of claim 1, wherein the cable comprises a second cable end attached to a fixed location.

3. The mast system of claim 2, wherein the fixed location is on the pivot support.

4. The mast system of claim 1, wherein a force is exerted on the leg support through the cable that causes the leg support to rotate about the joint as the mast is lowered.

5. The mast system of claim 4, wherein a distance between a fixed end of the cable and the first pulley increases as the mast is lowered wherein the increased distance passively exerts the force that moves the leg support.

6. The mast system of claim 5, wherein the distance between the fixed end of the cable and the first pulley decreases as the mast is raised wherein the decreased distance passively releases the force allowing the leg support to rotate downward.

7. The mast system of claim 6, wherein passively releasing the force allows the leg support to move into an operational position where the first support end aligns with a support connector incorporated into the rig surface.

8. The mast system of claim 7, further comprising a second pulley connected to the mast, wherein the first pulley is positioned at a higher elevation than the second pulley when the mast is in an upright position.

9. The mast system of claim 8, further comprising a third pulley connected to the mast that is positioned to direct the first cable end in an upward direction when the mast is being lowered.

10. The mast system of claim 1, wherein a force exerted on the leg support causes the leg support to move into a transport position.

11. The mast system of claim 1, wherein the rig surface is part of a mast transport skid.

12. A drill rig, comprising:

a back leg of a mast section pivotally connected to a pivot support at a pivot connector;

a front leg of the mast section pivotally connected to a leg support;

the leg support having a first support end with a surface connector to attach to a rig surface and a second support end with a leg connector to connect to the front leg to form a joint;

a cable with a first cable end attached to the leg support; and a first pulley connected to the back leg, the first pulley positioned to angle a first portion of the cable with respect to another portion of the cable;

wherein the back leg rotates about the pivot connector when the mast is raised to an upright position.

13. The drill rig of claim 12, wherein a distance between a fixed end of the cable and the first pulley increases as the mast section is lowered and a force is exerted on the leg support through the cable that causes the leg support to rotate about the joint as the mast section is lowered.

14. The drill rig of claim 13, wherein the distance between the fixed end of the cable and the first pulley decreases as the mast section is raised wherein the decreased distance passively releases the force allowing the leg support to rotate downward.

15. The drill rig of claim 14, wherein passively releasing the force allows the leg support to move into an operational position where the first support end aligns with a support connector incorporated into the rig surface.

16. The drill rig of claim 12, further comprising a third pulley connected to the mast section that is positioned to direct the first cable end in an upward direction when the mast section is being lowered.

17. The drill rig of claim 12, wherein the force exerted on the leg support causes the leg support to move into a transport position.

18. A drill rig, comprising:

a back leg of a mast section pivotally connected to a pivot support;

a front leg of the mast section pivotally connected to a leg support;

the leg support having a first support end with a skid connector to attach to a mast transport skid and a second support end with a leg connector to connect to the front leg;

a cable with a first cable end attached to the leg support;

a first pulley connected to the back leg, the first pulley positioned to angle a first portion of the cable with respect to another portion of the cable;

a second pulley is connected to the mast section, the first pulley being positioned at a higher elevation than the second pulley when the mast section is in an upright position; and a third pulley connected to the mast section that is positioned to direct the first cable end in an upward direction when the mast section is being lowered;

wherein a distance between a fixed end of the cable and the first pulley increases as the mast section is lowered;

wherein a force is exerted on the leg support through the cable that causes the leg support to rotate about the second support end into a transport position as the mast section is lowered;

wherein the distance between the fixed end of the cable and the first pulley decreases as the mast section is raised wherein the decreased distance passively releases the force allowing the leg support to rotate downward; and wherein passively releasing the force allows the leg support to move into an operational position where the first support end aligns with a support connector incorporated into the mast transport skid.

* * * * *